United States Patent [19]

Pickering et al.

[11] 4,100,458

[45] Jul. 11, 1978

[54] MULTIPACTOR DISCHARGE TUNED CO-AXIAL MAGNETRONS

[75] Inventors: Alan Hugh Pickering, Springfield; Michael Barry Clive Brady, Maldon; Peter Frederick Lewis, Chelmsford, all of England

[73] Assignee: English Electric Valve Company Limited, England

[21] Appl. No.: 750,855

[22] Filed: Dec. 15, 1976

[51] Int. Cl.[2] ..... H01J 25/50

[52] U.S. Cl. ..... 315/39.55; 313/103 R; 315/39.57; 315/39.77; 333/99 MP

[58] Field of Search ..... 315/39.51, 39.55, 39.57, 315/39.77; 313/103, 105; 333/99 MP

[56] References Cited

U.S. PATENT DOCUMENTS

| | | | |
|---|---|---|---|
| 3,748,592 | 7/1973 | Pickering | 333/99 MP |
| 3,885,221 | 5/1975 | Lewis | 333/99 MP |
| 3,967,155 | 6/1976 | Chavanat et al. | 315/39.55 |

FOREIGN PATENT DOCUMENTS

| | | | |
|---|---|---|---|
| 2,351,390 | 12/1973 | Fed. Rep. of Germany | 315/39.55 |
| 1,382,630 | 2/1975 | United Kingdom | 333/99 MP |

*Primary Examiner*—Saxfield Chatmon, Jr.

[57] ABSTRACT

This invention relates to a co-axial magnetron in which a separate resonator incorporating a multipactor discharge arrangement is used to tune the operating frequency of the magnetron. The separate resonator is symmetrically coupled via couplers into the main resonator cavity of the magnetron. More than one separate resonant can be provided, in which case they are symmetrically coupled into the main resonant cavity to achieve correct tuning.

21 Claims, 6 Drawing Figures

MULTIPACTOR DISCHARGE TUNED CO-AXIAL MAGNETRONS

Figure 1:
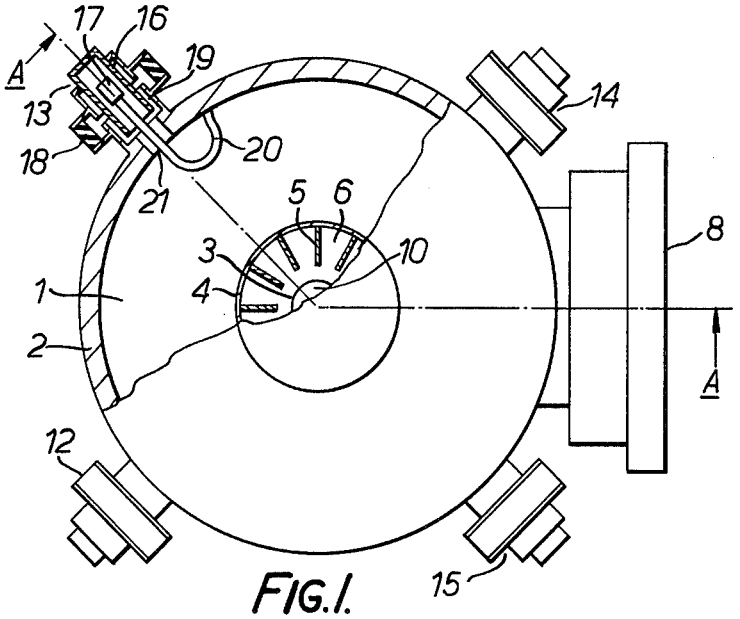

This invention relates to co-axial magnetrons, that is to say, magnetrons in which a resonant cavity co-axially surrounds an anode structure.

Various expedients have been suggested by which the resonant frequency of a co-axial magnetron may be tuned. Hitherto it has been usual to attempt to provide some form of mechanical tuning system, such as a mechanism for moving an annular end plate of the co-axial cavity. Not only is the use of a mechanical system undesirable in many cases, but also if such systems are to result in a useful degree of frequency change, it is difficult to arrange for the system to maintain symmetry about the magnetron axis. In a co-axial magnetron symmetry is of considerable importance particularly where, as is usually the case, attenuating material is introduced into the resonant structure. If symmetry is upset the resulting disturbance of the field pattern in the co-axial cavity can cause excessive coupling of r.f. power into such attenuators.

The present invention seeks to provide an improved co-axial magnetron which is capable of exhibiting a change in resonant frequency without requiring a mechanical moving tuning member.

According to this invention, a co-axial magnetron includes at least one separate resonator incorporating a multipactor discharge arrangement for modifying the resonant characteristics of the separate resonator and means for coupling said resonator or resonators symmetrically into the main resonant cavity of said magnetron.

One only separate resonator incorporating a multipactor discharge arrangement may be provided, in which case preferably said separate resonator comprises a cavity co-axially surrounding part of the outer wall of said main co-axial cavity, at one end thereof, and extending over an end closure thereof, a plurality of coupling probes being provided extending through apertures in said end closure to couple said separate resonator cavity to said main co-axial cavity. Preferably again said multipactor discharge arrangement comprises an annular electrode, extending within said separate resonator cavity and around said outer wall of said main co-axial cavity. Preferably said annular electrode is supported in insulated fashion by a plurality of rod electrodes extending through an outer wall member of said separate resonator cavity, whereby bias potential for said annular electrode may be applied via one or more of said rod electrodes. Said annular electrode may be divided into a plurality of segments, each supported by at least one rod electrode whereby bias potential may be applied independently to each of said segments.

A co-axial magnetron in accordance with this invention may also include a plurality of separate resonators each of which includes a multipactor discharge arrangement for modifying the resonant characteristic of the resonator and means for coupling each of said separate resonators substantially symmetrically into the main co-axial resonant cavity of said magnetron. Said separate resonators may be coupled into said co-axial resonant cavity through an end closure thereof, and/or apertures in the co-axial outer wall thereof, preferably the latter. Said coupling may be by means of apertures alone, but preferably said coupling involves the use of a coupling loop passing through an aperture for each separate resonator.

In one embodiment of the invention, for each separate resonator a coupling loop extends through an aperture in the outer co-axial wall of said co-axial resonant cavity, which coupling loop supports the inner one of a pair of co-axial cylinders forming the multipactor discharge arrangement therefore. Preferably the outer of said two cylinders is extended and closed at one end to form a resonant circuit of length $3\lambda/4$, where $\lambda$ is the wavelength at the mean frequency of operation of said magnetron. Preferably said outer cylinder is connected to the outer co-axial wall of said co-axial resonant cavity by means including an insulator and $\lambda/4$, r.f. choke arrangement whereby bias potential may be applied to said outer cylinder.

Typically between four and twelve separate resonators are provided.

Preferably means are provided for causing the multipactor discharge arrangements within the separate resonators to be irradiated, during operation, by X-rays, in which case where the anode structure of said co-axial magnetron comprises an annular cylinder which is internally vaned with coupling slots provided in said annular cylinder at alternate cavities between vanes, preferably said coupling slots are arranged such that X-rays generated, in operation, at the tips of said vanes by electron bombardment are afforded passage through a coupling slot to a multipactor discharge arrangement within a separate resonator.

In operation, the frequency changes brought about by the effect of each multipactor discharge within a separate resonator will be cumulative. In operation, the number of multipactor discharge arrangements which are caused to discharge (or alternately inhibited from discharging) may be chosen in dependence upon the degree of frequency change which is required. In such a case, however, care should be taken to ensure that any combination of separate resonators which are affected is such that a sufficient symmetry of modulation of the field pattern in the co-axial resonant cavity is maintained.

Figure 2:
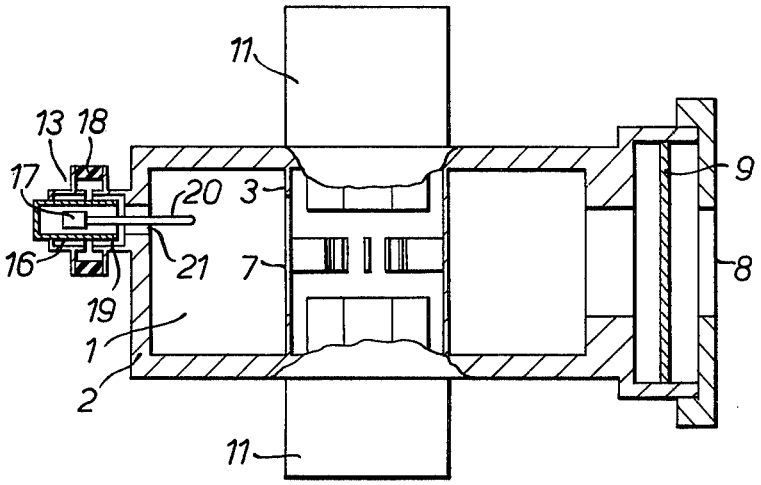
Figure 3:
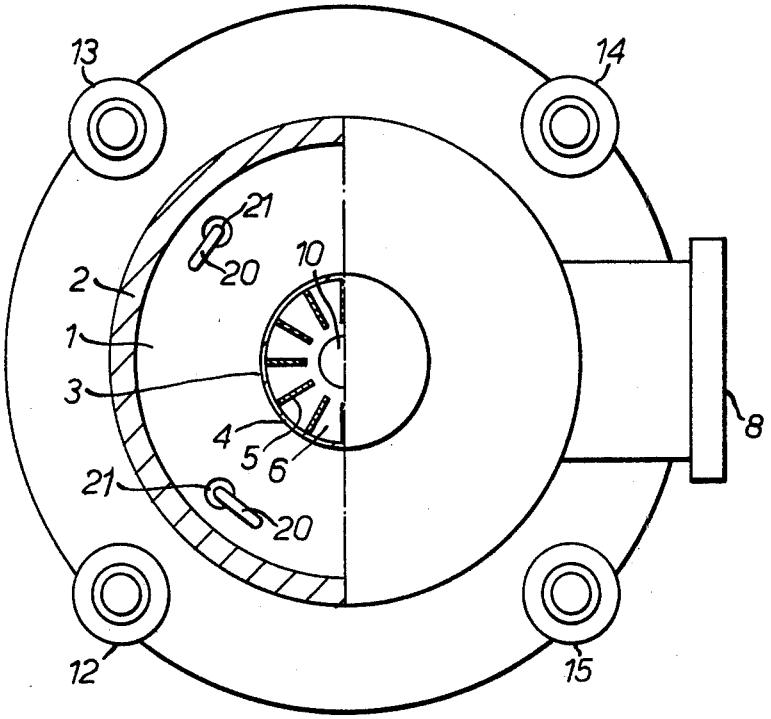
Figure 4:
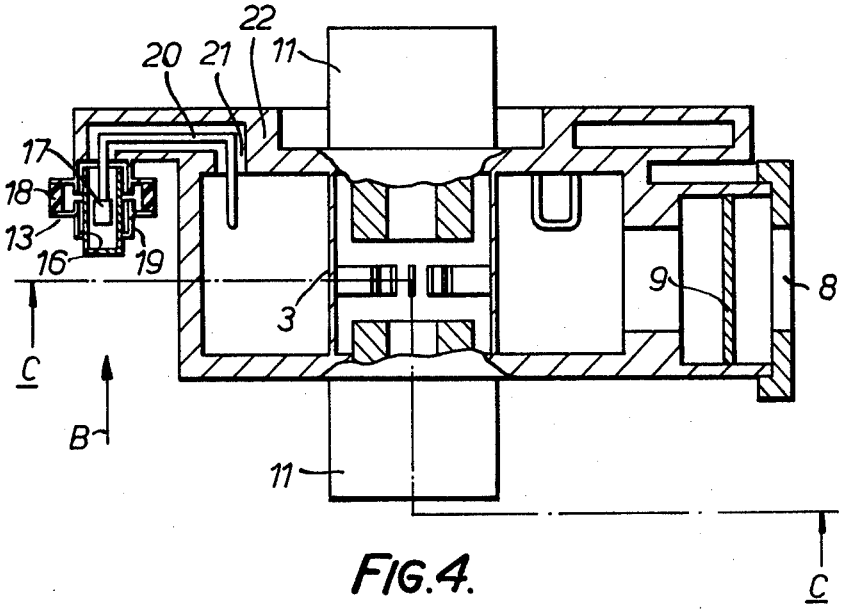
Figure 5:
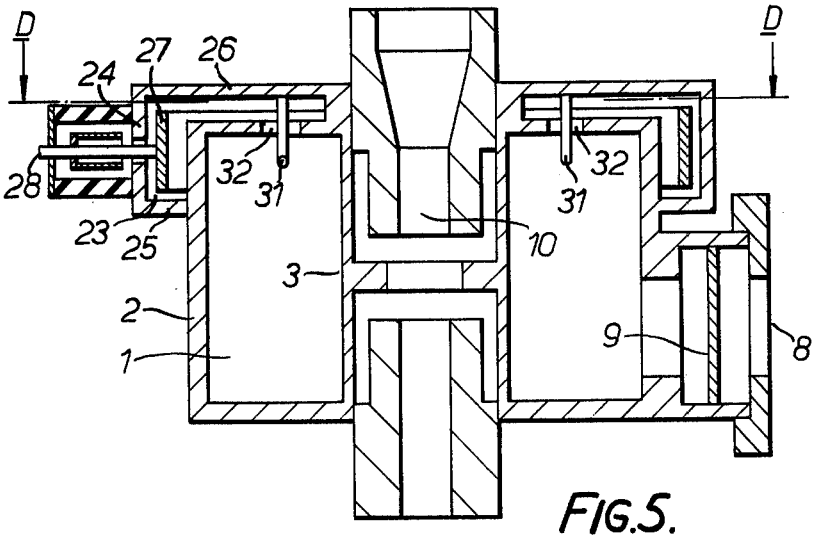
Figure 6:
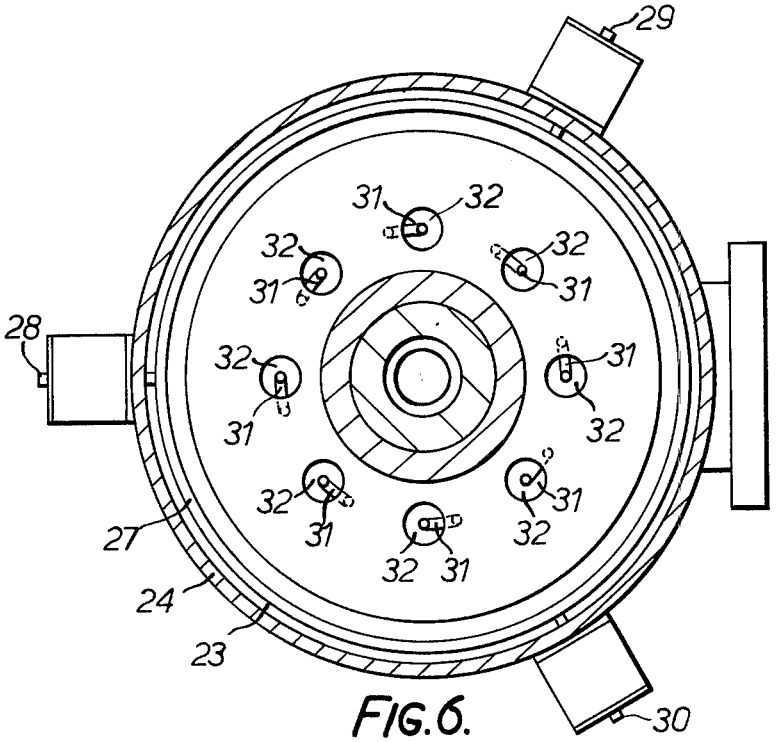

The invention is illustrated in and further described with reference to the accompanying drawings in which, FIG. 1 is a part section plan view of one multipactor discharge tuned co-axial magnetron in accordance with the present invention in which a plurality of separate resonators are provided, FIG. 2 is a section along the line AA of FIG. 1, FIG. 3 is a sectional plan view of another multipactor discharge tuned co-axial magnetron in accordance with the present invention, in which a plurality of separate resonators are provided, FIG. 4 shows a view of the magnetron of FIG. 3 in the direction of the arrow B, part sectioned along the line CC, FIG. 5 is a section through one multipactor discharge tuned co-axial magnetron in accordance with the present invention, in which a single separate resonator is provided and FIG. 6 is a plan view of the magnetron of FIG. 5 sectioned along the line DD.

In all Figures, like references are used for like parts.

Referring to the drawings, the magnetron consists of a $TE_{01}$ resonant cavity 1 provided between an outer cavity wall 2 and a cylindrical vaned anode structure 3. The anode structure 3 is of typically known kind consisting of an outer cylindrical wall 4 having internal vanes 5 providing internal cavities 6. Coupling between the cavities 6 of the anode structure 3 and the co-axial resonant cavity 1 is provided for by a series of slots 7 provided in the wall member 4 at the back of alternate ones of the cavities 6. An output port 8 having a window 9 is provided to couple energy out of the resonant cavity 1. Co-axially within the anode structure 3 is a cathode 10 and pole pieces 11, co-axial with the anode structure 3, are provided to produce a magnetic field in operation.

As so far described the construction of the co-axial magnetron is as known per se.

In accordance with the present invention a plurality of separate resonators are provided each containing a multipactor discharge arrangement provided to affect the resonant frequency thereof, said separate resonators being coupled substantially symmetrically into the co-axial resonant cavity of the magnetron.

In FIG. 1 four separate resonators 12, 13, 14 and 15 are shown, each in the form of two co-axial cylinders 16, 17 of which the outer cylinder 16 is extended and formed into a cavity, in this case three quarters of a wavelength in length. The inner cylinder 17 and the outer cylinder 16 also provide a multipactor discharge arrangement forming the capacitive part of the resonator. As is conventional, at least one of the opposing faces of the cylinders 16 and 17 is of high secondary electron emitting coefficient to effect multipactor discharge therebetween. In order to apply bias potential to the cylinder 16 an arrangement of insulator 18 and a quarter wave choke 19 is provided as known per se.

The inner cylinder 17 is mounted on one end of a coupling loop 20 which extends through a hole 21 in outer wall 2 of the main co-axial resonant cavity 1 and is connected at the end of its looped portion to the interior of the outer wall 2.

The couplings of the separate resonators 12 to 15 are made symmetrically around the main co-axial resonant cavity 1 in order to avoid disrupting the field pattern within the resonant cavity 1.

The multipactor discharge arrangement consisting of the co-axial cylinders 16 and 17 in each of the separate resonators 12 to 15 are arranged to be irradiated in operation by X-rays in order to assist in the starting of the multipactor discharge. In this example, the source of the X-rays is within the anode structure 3. The coupling slots 7 are so arranged with respect to the separate resonators 12 to 15 that X-rays generated at the tips of the vanes 5 in operation, by electron bombardment, are afforded passage to the two cylinders 16 and 17.

Referring to FIGS. 3 and 4, the co-axial magnetron illustrated therein is similar to that illustrated in FIGS. 1 and 2 except that in this case the four separate resonators 12, 13, 14 and 15 are coupled symmetrically into the cavity 1 by means of probes 20 through holes 21 provided in an end closure 22. In this case the looped ends of the probes 20 are connected to the interior surface of the end closure 22.

Referring to FIGS. 5 and 6, in this case, instead of a plurality of separate resonators, a single separate resonator 23 is provided. This single separate resonator 23 is formed by a short cylindrical wall member 24 which surrounds an upper (as viewed) portion of outer wall 2. A base wall member 25 extends between the bottom of wall member 24 and outer wall 2. Wall member 24 extends above outer wall 2 and an upper wall member 26 extends above cavity end closure 22 so that a cavity is formed which extends around the upper end of wall member 24 and over end closure 22.

Between wall member 24 and outer wall 2 an annular electrode 27 is provided. Electrode 27 is supported by three rod electrodes 28, 29 and 30 extending, in insulated fashion, through wall member 24. Annular electrode 27 and the upper portion of outer wall 2 form a multipactor discharge arrangement. Bias potential for controlling the discharge may be applied in parellel to all of the rod electrodes 28, 29 and 30, which are distributed symmetrically around the axis of the magnetron.

The separate resonator 23 is coupled symmetrically into the main co-axial cavity 1 at a plurality (in this case eight) of points arranged symmetrically around the axis of the magnetron, by means of probes 31 extending through holes 32 in end closure 22. Again probes 31 are looped over at their ends within cavity 1 and attached to the undersurface of end closure 22, within cvity 1.

The annular electrode 27 may be divided into a plurality of segments, each supported by at least one rod electrode like rod electrodes 28, so that a series of independently controllable multipactor discharge electrodes are provided within the single separate resonator cavity. This is not illustrated however.

We claim:

1. A co-axial magnetron including an anode structure having a plaurlity of cavities, and a main resonant cavity co-axially surrounding said anode structure, said anode structure including coupling means for coupling the cavities thereof with said main resonant cavity and at least one resonator separate from said main cavity and incorporating a multipactor discharge arrangement for modifying the resonant characteristics of the separate resonator and means for coupling said resonator or resonators symmetrically into the main co-axial resonant cavity of said magnetron.

2. A magnetron as claimed in claim 1 and wherein there is provided one only separate resonator incorporating a multipactor discharge arrangement.

3. A magnetron as claimed in claim 2 and wherein said separate resonator comprises a cavity co-axially surrounding part of the outer wall of said main co-axial cavity, at one end thereof, and extending over an end closure thereof, a plurality of coupling probes being provided extending through apertures in said end closure to couple said separate resonator cavity to said main co-axial cavity.

4. A magnetron as claimed in claim 3 and wherein said multipactor discharge arrangement comprises an annular electrode, extending within said separate resonator cavity and around said outer wall of said main co-axial cavity.

5. A magnetron as claimed in claim 4 and wherein said annular electrode is supported in insulated fashion by a plurality of rod electrodes extending through an outer wall member of said separate resonator cavity, whereby bias potential for said annular electrode may be applied via one or more of said rod electrodes.

6. A magnetron as claimed in claim 5 and wherein said annular electrode is divided into a plurality of segments each supported by at least one rod electrode whereby bias potential may be applied independently to each of said segments.

7. A magnetron as claimed in claim 1 and including a plurality of separate resonators each of which includes a multipactor discharge arrangment for modifying the resonant characteristic of the resonator and means for coupling each of said separate resonators substantially symmetrically into the main co-axial resonant cavity of said magnetron.

8. A magnetron as claimed in claim 7 and wherein said separate resonators are coupled into said co-axial resonant cavity through an end closure thereof.

9. A magnetron as claimed in claim 7 and wherein said separate resonators are coupled into said co-axial resonant cavity through apertures in the co-axial outer wall thereof.

10. A magnetron as claimed in claim 9 and wherein said coupling is by means of apertures alone.

11. A magnetron as claimed in claim 9 and wherein said coupling involves the use of a coupling loop passing through an aperture for each separate resonator.

12. A magnetron as claimed in claim 9 and wherein for each separate resonator a coupling loop extends through an aperture in the outer co-axial wall of said co-axial resonant cavity, which coupling loop supports the inner cylinder of a pair of co-axial cylinders forming the multipactor discharge arrangement therefore.

13. A Magnetron as claimed in claim 12 and wherein the outer of said two cylinders is extended and closed at one end to form a resonant circuit of length $3\lambda,/4$ where $\lambda$ is the wavelength at the mean frequency of operation of said magnetron.

14. A magnetron as claimed in claim 12 and wherein said outer cylinder is connected to the outer co-axial wall of said co-axial resonant cavity by means including an insulator and $\lambda,/4$ r.f. choke arrangement whereby bias potential may be applied to said outer cylinder.

15. A magnetron as claimed in claim 7 and wherein between four and twelve separate resonators are provided.

16. A magnetron as claimed in claim 7 and wherein means are provided for causing the multipactor discharge arrangements within the separate resonators to be irradiated, during operation, by X-rays.

17. A magnetron as claimed in claim 16 and wherein the anode structure of said co-axial magnetron comprises an annular cylinder which is internally vaned with coupling slots provided in said annular cylinder at alternate cavities between vanes said coupling slots being arranged such that X-rays generated, in operation, at the tips of said vanes by electron bombardment are afforded passage through a coupling slot to a multipactor discharge arrangement within a separate resonator.

18. In a co-axial magnetron including an anode structure having a plurality of cavities, and a resonant cavity co-axially surrounding said anode structure, said anode structure including coupling means for coupling the cavities thereof with said resonant cavity, and said resonant cavity including output means for coupling energy out of the resonant cavity, the improvement which comprises:

resonator means disposed externally of said resonant cavity for tuning the resonant frequency of said magnetron, said resonator means including multipactor discharge means and means for controlling multipactor discharge thereof; and resonator coupling means for coupling said resonator means into said resonant cavity of the magnetron symmetrically about the axis of said magnetron.

19. In a co-axial magnetron as defined in claim 18 wherein said resonator means comprises a plurality of separate resonators disposed symmetrically about the axis of said magnetron.

20. In a co-axial magnetron as defined in claim 18 wherein said resonator means comprises a single resonator.

21. In a co-axial magnetron having a resonant cavity provided with output means for coupling energy out of the resonant cavity, and an anode structure disposed co-axially within said resonant cavity and coupled thereto, the improvement which comprises:

resonator means disposed externally of said resonant cavity for tuning the resonant frequency of said magnetron, said resonator means comprising first and second multipactor discharge electrode means; and resonator coupling means connected to one of said multipactor discharge electrode means and extending into said resonant cavity of said magnetron at a plurality of locations distributed symmetrically around the axis of said magnetron for coupling said resonator means symmetrically into said resonant cavity.

* * * * *

UNITED STATES PATENT AND TRADEMARK OFFICE

CERTIFICATE OF CORRECTION

PATENT NO. : 4,100,458

DATED : July 11, 1978

INVENTOR(S) : Alan Hugh Pickering, et al

It is certified that error appears in the above–identified patent and that said Letters Patent are hereby corrected as shown below:

---[30] Foreign Application Priority Data

December 19, 1975 Great Britain appln. no. ...52211/75---

Signed and Sealed this

*Fifth* Day of *December 1978*

[SEAL]

*Attest:*

RUTH C. MASON
*Attesting Officer*

DONALD W. BANNER
*Commissioner of Patents and Trademarks*